US005642534A

United States Patent [19]

Sanchez et al.

[11] Patent Number: 5,642,534

[45] Date of Patent: Jul. 1, 1997

[54] SPA WEIR GATE

[76] Inventors: Manuel Sanchez, 2989 Oakbrook Dr., Riverside, Calif. 92503; Michael S. Deans, 1606 Woodcreek Cir., Athens, Tenn. 37303; Wilbur R. Holmes, 135 Commodore Dr., Jupiter, Fla. 33477; Susan L. Holmes, 4340 Deodar Dr., Yorba Linda, Calif. 92686

[21] Appl. No.: 536,375

[22] Filed: Sep. 29, 1995

[51] Int. Cl.[6] ..... E04H 4/14

[52] U.S. Cl. ..... 4/507; 4/541.3; 210/169; 210/242.1; 405/96; 405/106

[58] Field of Search ..... 4/490, 507, 509, 4/512; 210/169, 242.1, 416.2; 405/96, 104, 105, 106

[56] References Cited

U.S. PATENT DOCUMENTS

| | | | |
|---|---|---|---|
| 3,212,268 | 10/1965 | Ortega | 210/169 X |
| 3,252,576 | 5/1966 | Miller | 210/169 X |
| 3,953,978 | 5/1976 | Soileau | 405/104 |
| 4,474,210 | 10/1984 | Schmid | 405/104 X |
| 4,533,476 | 8/1985 | Watkins | 210/805 |
| 4,552,658 | 11/1985 | Adcock et al. | 210/169 |
| 4,608,167 | 8/1986 | Ruabenheimer | 4/490 X |
| 5,078,863 | 1/1992 | Durigon | 210/169 |
| 5,267,359 | 12/1993 | Clark | 4/509 |
| 5,392,471 | 2/1995 | Vos | 4/507 |

OTHER PUBLICATIONS

"Sundance Means State-Of-The-Art Performance And Value", Sundance Spas, Clark Manufacturing, Inc., 1993, 2 pages.

*Primary Examiner*—Robert M. Fetsuga

[57] ABSTRACT

The weir gate includes a pair of spaced juxtaposed guides that are disposed vertically on either side of an opening between the interior of a spa and a filtration cavity. A lower gate is fixed to and spans the guides in a generally vertical plane. A floating gate is disposed between the guides, and can be placed in an upper position to regulate the flow of surface water into the filtration cavity and in a lower recessed position adjacent the lower gate to provide access to the filter cavity. An upper latch mechanism holds the floating gate in the upper position so that it pivots in a plane generally orthogonal to the lower gate and its upper edge floats near the surface of the water in the spa. A lower latch mechanism holds the floating gate in the lower position adjacent the lower gate so that a user can access the filters without having to hold the floating gate down.

18 Claims, 5 Drawing Sheets

SPA WEIR GATE

BACKGROUND OF THE INVENTION

1. Field of the Invention

The present invention generally relates to spa weir gates, and more specifically to a weir gate that pivots so that it floats near the surface of the water in the spa and retracts to provide access to the spa's filters.

2. Description of the Related Art

In general, a spa circulates water at a relatively high rate to provide the water pressure and turbulence desired for therapeutic massage. A pump injects water through a number of jets into the spa, and a high pressure suction outlet draws water from the spa through a filtration system and returns it to the pump. High suction pressure at an exposed outlet is annoying and potentially dangerous. Furthermore, drawing water from the spa below the surface provides inefficient filtration. Typically, most of the debris floats on the surface of the water.

These problems are solved by using a weir gate which floats near the surface of the water and separates the interior of the spa from the filtration system and suction outlet. The weir gate is designed so that the pressure drop across it is relatively low and the spa user is isolated from the high suction outlet. The suction causes the surface water to be drawn over the weir gate and through the filtration system, thereby increasing its efficiency.

Adcock et al., U.S. Pat. No. 4,552,658 "Spa With Recessed Filter Chamber" disclose a weir gate that is pivotally mounted on the spa shell between the interior of the spa and the filter cavity. The weir gate pivots towards the high suction outlet in the filter cavity so that its upper edge floats near the surface of the water in the spa. Surface water is drawn over the weir gate, through a filter and returned to the suction outlet.

The filters must be frequently removed from the filter cavity for cleaning and routine maintenance. To remove the filters, a user removes a lid that is positioned above the filter cavity and moves the weir gate to a position rotated 90° away from the filter cavity. The user must use one hand to hold the weir gate. Otherwise the weir gate will return to its desired position and get in the way. The user is inconvenienced by having to remove and then replace the lid.

Wilsey J. Clark, U.S. Pat. No. "Water Turbulence Generation In Spas" discloses a weir gate which includes a lower gate, a pair of juxtaposed guides that are positioned on either end of the lower gate and extend vertically therefrom, and a floating gate whose sides are disposed in the guides for vertical reciprocation. The weir gate is placed between the filter cavity and spa interior so that the floating gate moves up-and-down with the water level. The Clark spa also requires a removable cover to access the filters in the cavity. Otherwise, the user would have to hold the floating gate down while trying to access the filters.

L. A. Spas, the assignee of the present invention, produces a weir gate that is similar to the Clark gate and exhibits the same problems.

SUMMARY OF THE INVENTION

The present invention provides a weir gate that improves access to a spa's filtration system.

The weir gate is positioned in an opening between the interior of the spa and a filtration cavity. The weir gate includes a pair of spaced juxtaposed guides that are disposed vertically on either side of the opening. A lower gate is fixed to and spans the guides in a generally vertical plane that is offset from the plane of the guides. A floating gate is disposed between the guides, and can be placed in an upper position where its lower edge is adjacent the upper edge of the lower gate to regulate water flow to the filtration cavity, and in a lower recessed position adjacent the lower gate to provide access to the filter cavity. An upper latch mechanism holds the floating gate in the upper position so that it pivots in a plane generally orthogonal to the lower gate and its upper edge floats near the surface of the water in the spa. A lower latch mechanism holds the floating gate in the lower position adjacent the lower gate so that a user can access the filters without having to hold the floating gate down. The improved access to the filter cavity allows the spa to be formed with a fixed cover over the filter cavity.

For a better understanding of the invention, and to show how the same may be carried into effect, reference will now be made, by way of example, to the accompanying drawings.

DETAILED DESCRIPTION OF THE INVENTION

Figure 1:
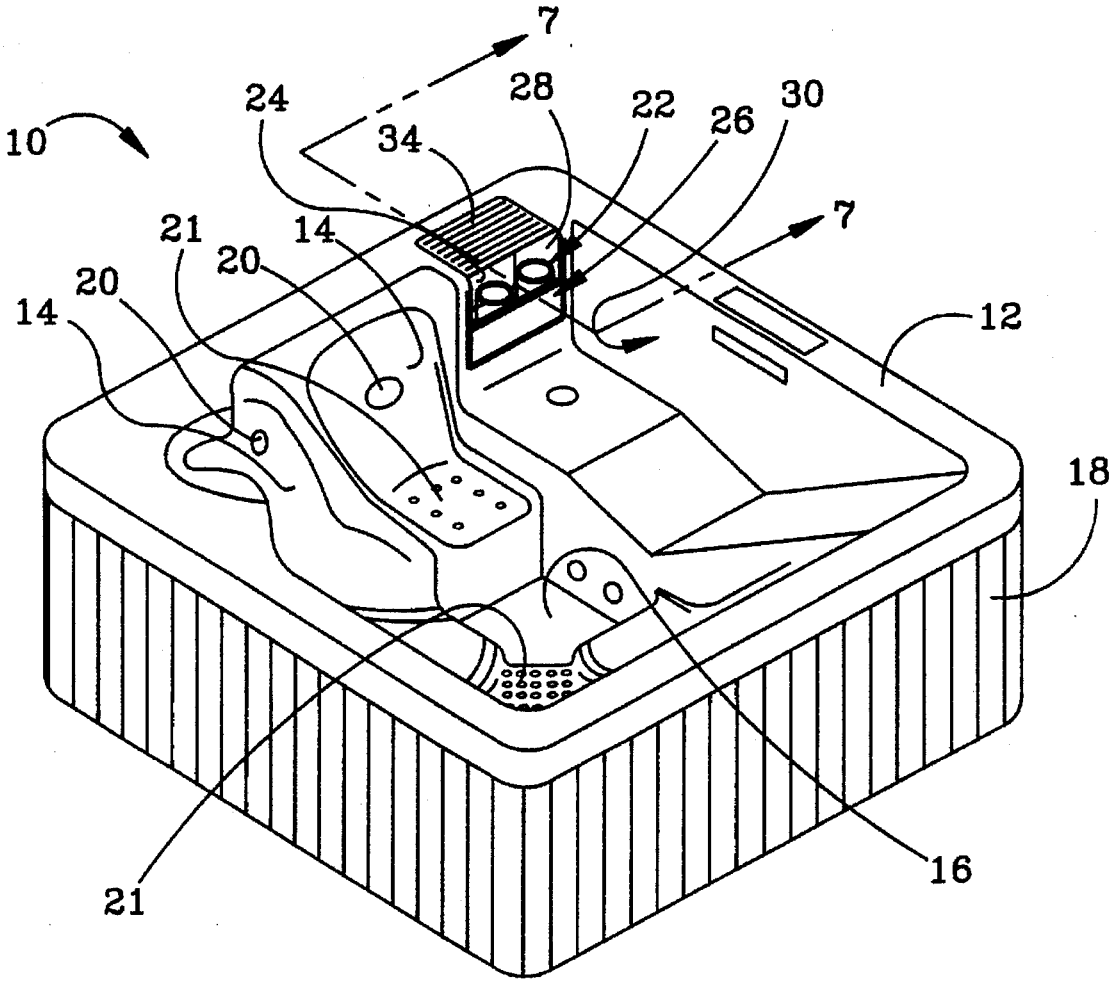
FIG. 1 is a perspective view of a spa and a weir gate in accordance with the present invention.

As shown in FIG. 1, a spa 10 includes a molded shell 12, suitably plastic or fiberglass, that is formed with a number of seats 14 around a foot well 16. Shell 12 is mounted in an enclosure 18, typically a wooden frame, that also houses the water circulation, bubble forming, heating and control systems (not shown). The circulation system expels high pressure water through jets 20 and forces air bubbles through holes 21 in shell 12. The spa water is returned through filters 22 that are positioned in a recessed filter cavity 24.

A weir gate 26 is positioned in an opening 28 between the interior 30 of shell 12 and filter cavity 24. During normal use, weir gate 26 is placed in an upper position so that it pivots and floats near the surface of the water in spa 10. This allows the water and debris at the surface to be drawn over weir gate 26 and through filters 22. To clean and maintain filters 22, weir gate 26 is placed in a retracted lower position so that the filters are accessible to the spa user. By designing weir gate 26 so that it can be retracted to provide adequate access to filters 22, shell 12 can be formed with a permanent cover 34 over filter cavity 24. A permanent cover is preferable to a removable one because it is more aesthetically pleasing and the spa user does not have to remove and then replace it to clean filters 22. However, the spa can be designed for use with a removable cover.

Figure 2:
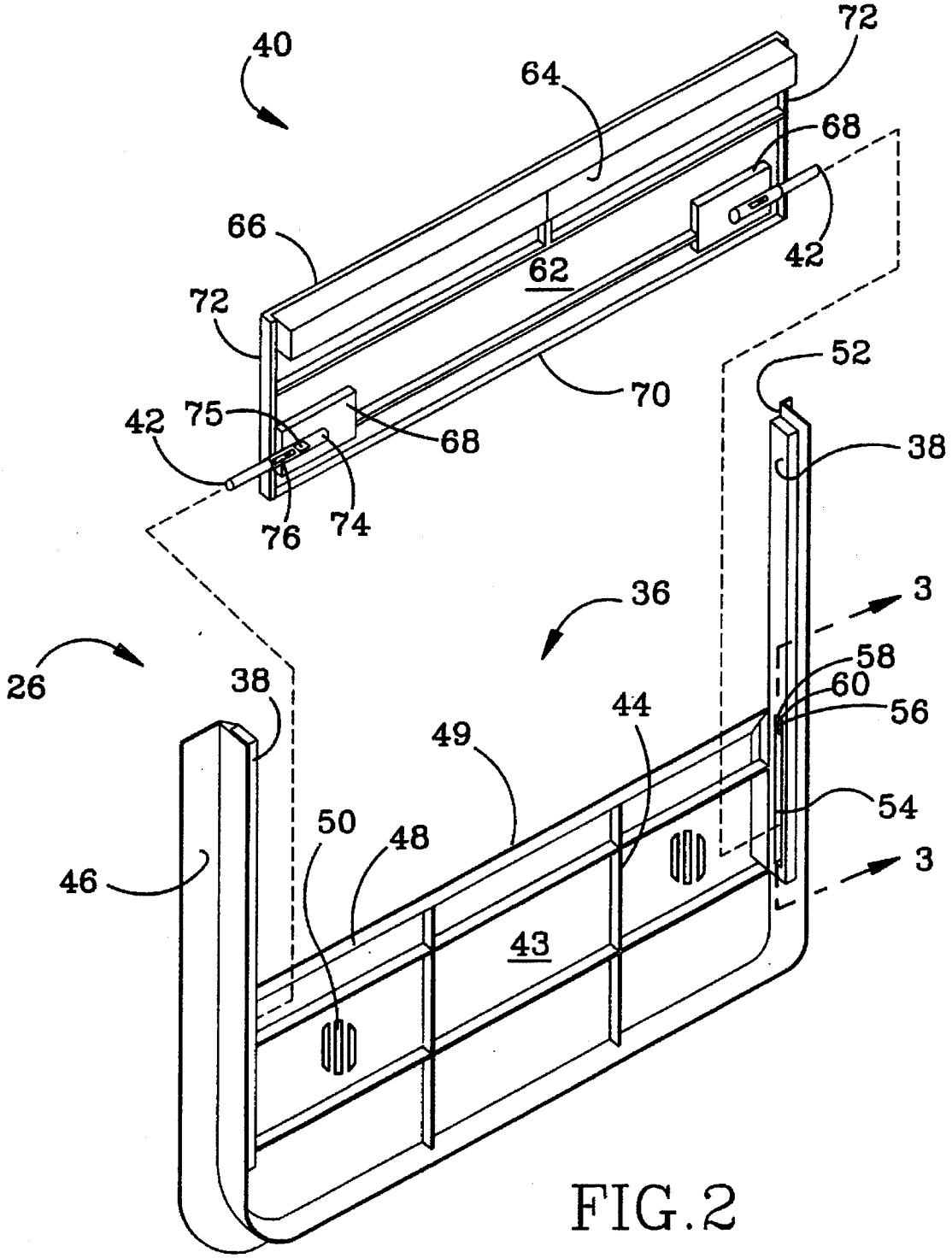
FIG. 2 is a partially exploded perspective view of the weir gate shown in FIG. 1.

FIG. 2 is a partially exploded view of weir gate 26, which includes a lower fixed gate 36 that spans the distance between a pair of juxtaposed guides 38, and a floating gate 40 having pins 42 that are disposed in guides 38. During normal use, pins 42 are held in an upper position so that floating gate 40 pivots as the water level changes. To clean the filters, pins 42 are released and slid vertically down guides 38 so that floating gate 40 is placed in its lower position behind and parallel to lower fixed gate 36.

Lower gate 36 is a generally rectangular shaped plastic plate 43 that has ribs 44 on its back side to add strength. To affix weir gate 26 to spa 10, a U-shaped right-angle member 46 is formed around three sides of lower gate 36. The lower gate's upper edge 48 is curved from front-to-back to form a lip 49 (shown in detail in FIG. 6). Hole patterns 50 are formed in plate 43 so that water flows into the filtration cavity even when the water level falls below the height of upper edge 48. This is done to prevent cavitation of the spa's pumping system.

Figure 3:
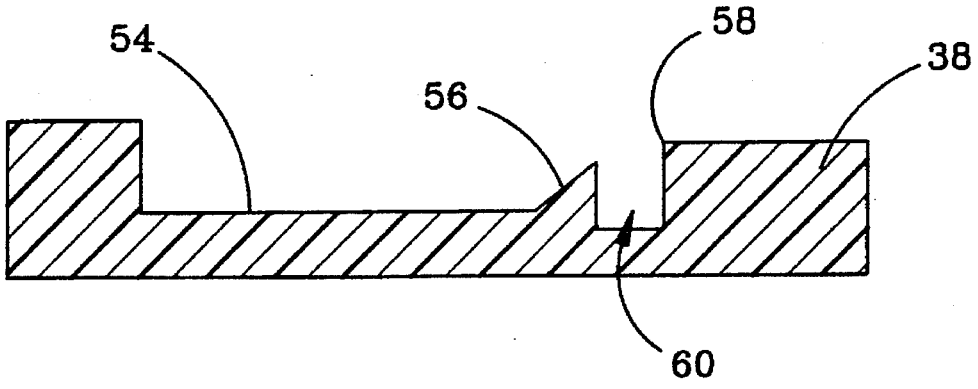
FIG. 3 is a sectional view of one of the tracks along which the weir gate reciprocates between its upper and lower positions.

Guides 38 are attached to inner surfaces 52 on U-shaped member 46 so that they lie in a vertical plane that is offset from and preferably behind the plane of lower gate 36. Recessed tracks 54, which are suitably approximately ¼" (0.64 cm) wide, ⅛" (0.32 cm) deep and 5" (12.7 cm) long, are formed in guides 38 for vertical reciprocation of floating gate 40 between its upper and lower positions. FIG. 3 shows a sectional view of guide 38 along the longitudinal axis of track 54, in which a detent 56 is formed approximately ¼" (0.64 cm) from the track's upper end 58 to provide a socket 60. Upper end 58 preferably lies below the height of the lower gate's upper edge 48 so that when floating gate 40 pivots in its upper position it overlaps lower gate 36 to inhibit water flow between the gates. Lower gate 36, U-shaped member 46 and guides 38 may be formed from an integral plastic mold.

Floating gate 40 includes a rectangular plate 62 that approximately spans the distance between guides 38 and suitably has a height of approximately 5" (12.7 cm). A rectangular cavity 64 is formed on the back side of plate 62 at its upper edge 66, and is preferably filled with a porous material such as styrofoam having a buoyancy which will support floating gate 40 in a position at the surface of the water in spa 10.

A pair of brackets 68 are mounted on the back side of plate 62 along its bottom edge 70 and outer edges 72. Each bracket 68 includes a cylindrical sleeve 74 for holding a spring 75 and pin 42, approximately ¼" (0.64 cm) in diameter, substantially perpendicular to the plate's outer edge 72. The spring applies a force that tends to push pin 42 outward and resists pushing it inward. Pins 42 are formed with tabs 76 so that a user can pull the pins back, place floating gate 40 between guides 38, and release the pins so that they are held in tracks 54.

Figure 4:
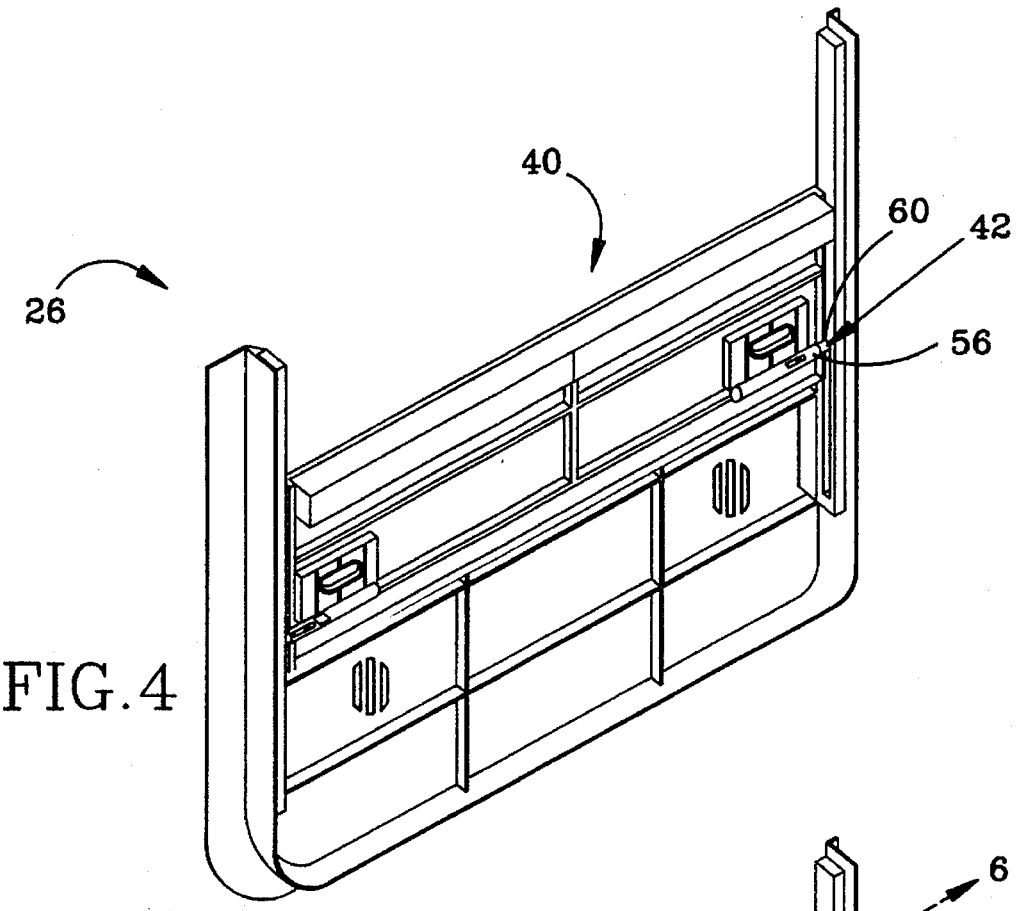
FIG. 4 is a perspective view of the weir gate shown in FIG. 2 in its upper position.

FIG. 4 shows weir gate 26 with floating gate 40 in its upper position where it can pivot from a vertical position for a high water level to an approximately horizontal position for a low water level. The filters 22 (shown in FIG. 1) prevent floating gate 40 from pivoting further than approximately 90°. Floating gate 40 is placed in its upper position by pulling up on it. The upward force causes pins 42 to deflect inward against the force of the spring as they move over detents 56. Once past detents 56, pins 42 snap back into sockets 60 and together they form an upper latch mechanism that holds floating gate 40 in its upper position.

Figure 5:
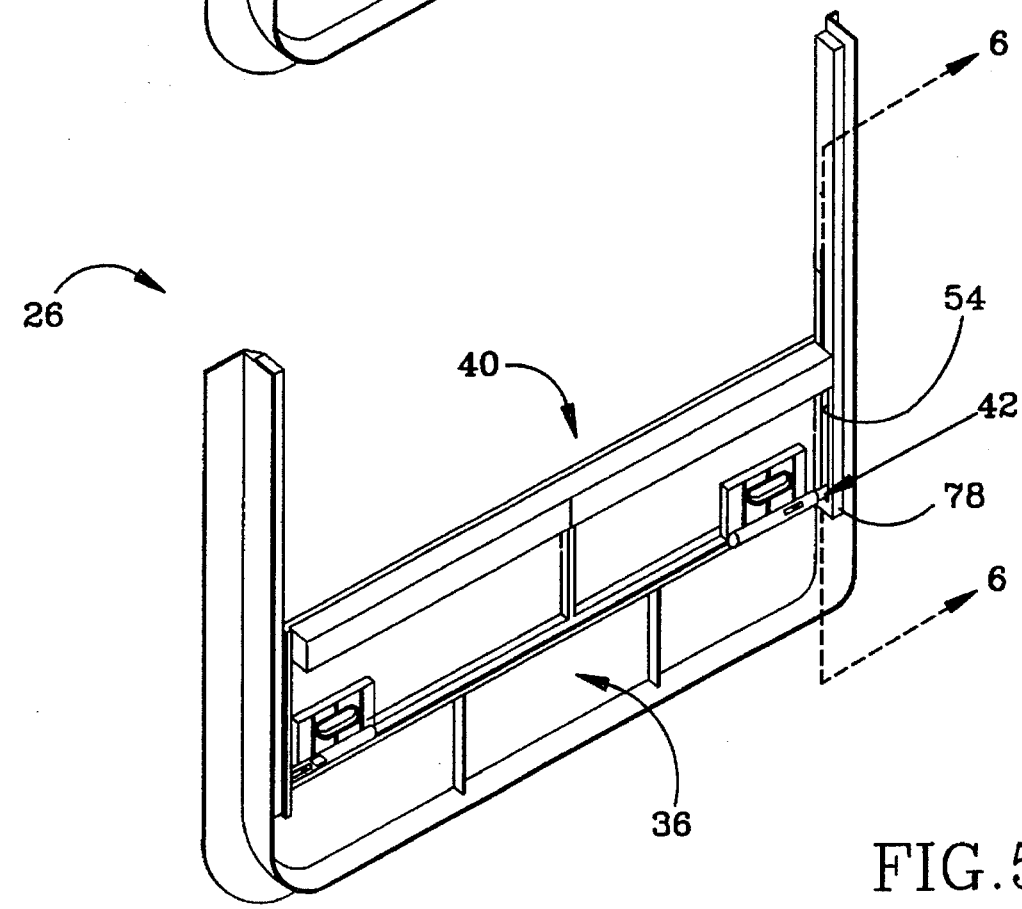
FIG. 5 is a perspective view of the weir gate shown in FIG. 2 in its lower position.

FIG. 5 shows weir gate 26 with floating gate 40 in its lower position where it is held against lower gate 36. Filters 22 (shown in FIG. 1) prevent floating gate 40 from pivoting into the filter cavity when in its lower position.

Figure 6:
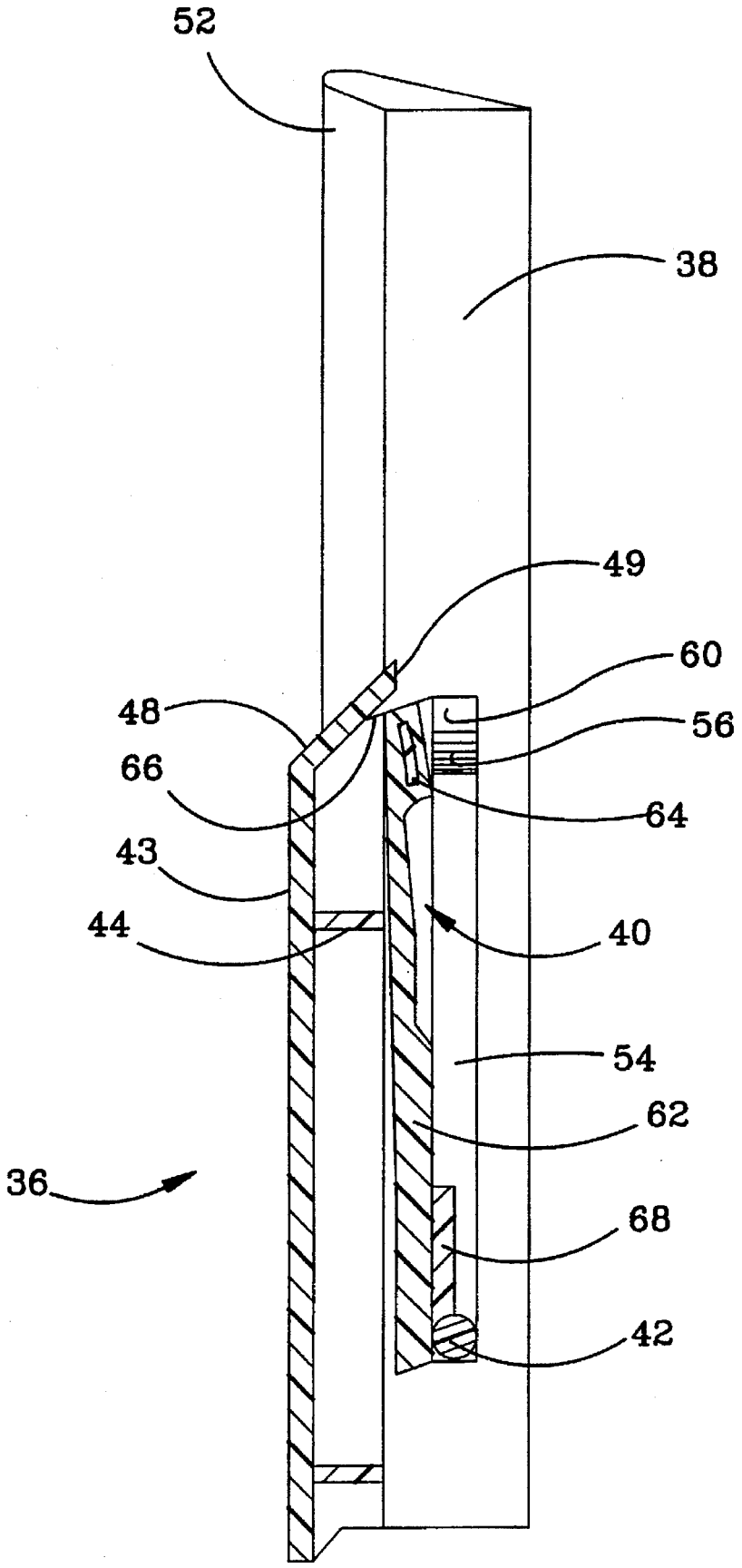
FIG. 6 is a sectional view of the weir gate along line 6—6 shown in FIG. 5.

As shown in FIG. 6, when floating gate 40 is in the lower position, it is tilted slightly towards lower gate 36 so that its upper edge 66 catches on lip 49 that is formed by the lower gate's upper edge 48, thereby providing a lower latch mechanism. An overlap of approximately 1/16" (0.16 cm) is sufficient to hold floating gate 40 in its lower position. This mechanism prevents floating gate 40 from floating back to the surface.

Figure 7A:
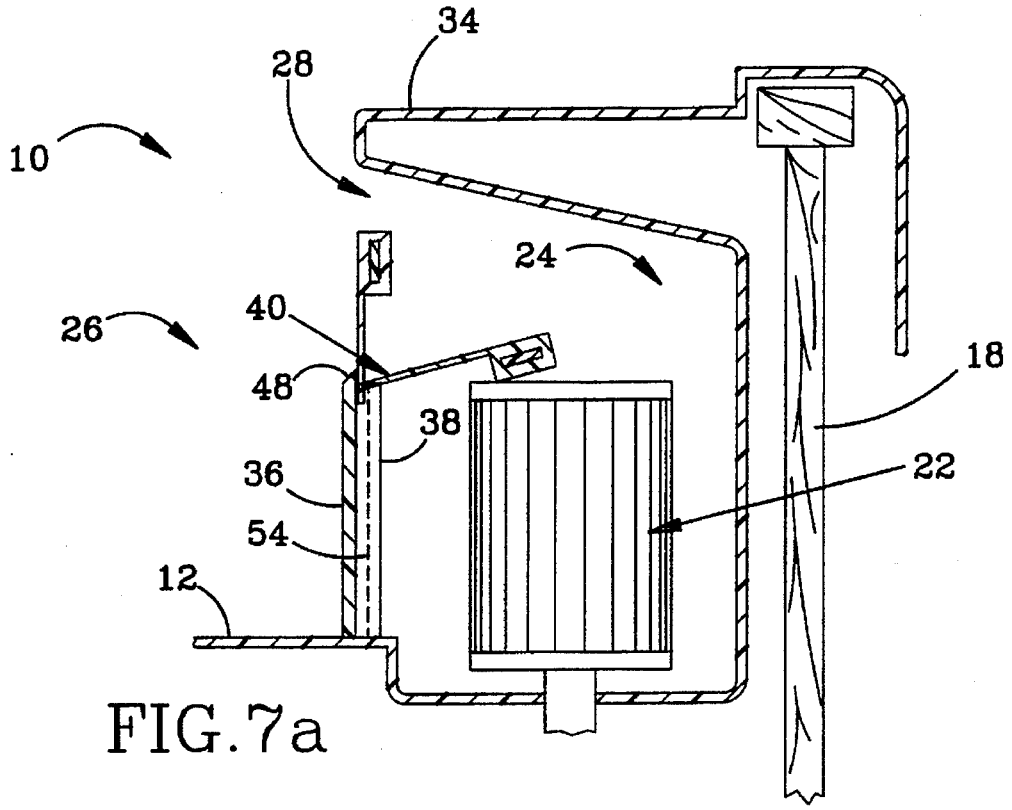
FIGS. 7*a* and 7*b* are sectional views of the spa and weir gate along line 7—7 shown in FIG. 1 in its upper and lower positions, respectively.
Figure 7B:
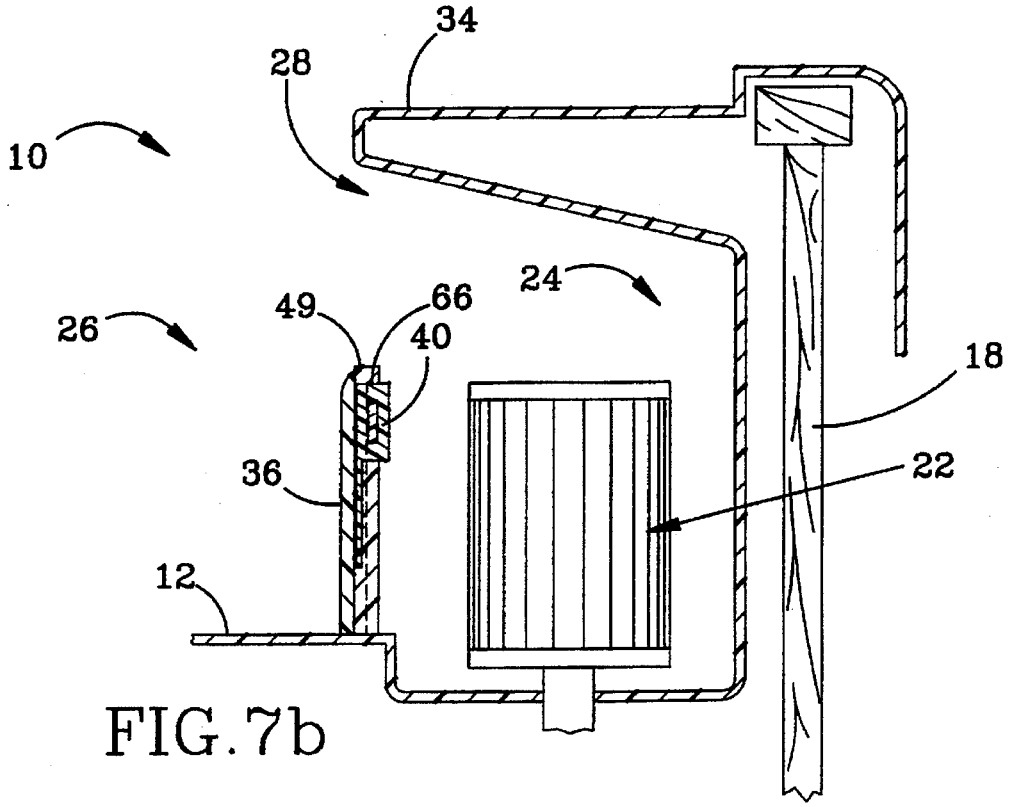

FIGS. 7*a* and 7*b* are sectional views of the filter area of spa 10 shown in FIG. 1, showing weir gate 26 in its upper and lower positions, respectively. In its upper position, floating gate 40 is pinned near the upper edge 48 of lower gate 36 so that it pivots from a substantially vertical position inward towards filter 22 as the water level changes. Water and debris spill over the floating gate's upper edge 66 into filter cavity 24. In its lower position, the floating gate's upper edge 66 is caught on the underside of the lower gate's lip 49 so that floating gate 40 is held behind lower gate 36.

While several illustrative embodiments of the invention have been shown and described, numerous variations and alternate embodiment will occur to those skilled in the art. For example, U-shaped member 52 and guides 38 could be cut-off at the level of lower gate 36. Furthermore, different types of latch mechanisms could be employed to hold floating gate 40 in its upper position so that it pivots with changes in the water level, and to hold it in its lower retracted position. Such variations and alternate embodiments are contemplated, and can be made without departing from the spirit and scope of the invention as defined in the appended claims.

We claim:

1. A weir gate for use with a spa, said spa having an opening to a recessed filter cavity, comprising:

a pair of spaced juxtaposed guides;

a lower gate that is fixed to and spans said guides in a generally vertical plane when said guides are vertically disposed in said opening, said lower gate having an upper edge;

a floating gate that is disposed between said guides, said floating gate having upper and lower edges; and a latch mechanism that holds the floating gate in an upper position with its lower edge adjacent said lower gate's upper edge so that the floating gate pivots within a plane that is generally orthogonal to said vertical plane to draw surface water in said spa over the floating gate's upper edge into the recessed filter cavity, said latch mechanism being releasable so that said floating gate can be moved to a lower position, said latch mechanism reengaging the floating gate at said lower position and holding it adjacent said lower gate to provide access to said filter cavity through said opening.

2. The weir gate of claim 1, wherein said lower gate has an upper lip, said latch mechanism comprising:

a lower latch mechanism that is formed by said lower gate's upper lip overhanging the floating gate's upper edge when the floating gate is in said lower position to resist upward movement of said floating gate; and an upper latch mechanism for pivotally holding said floating gate between said guides in said upper position so that it pivots in said orthogonal plane.

3. The weir gate of claim 1, wherein at least one hole is formed in said lower gate.

4. A weir gate for use with a spa, said spa having an opening to a recessed filter cavity, comprising:

a pair of spaced juxtaposed guides that include recessed tracks having upper and lower ends;

a lower gate having an upper edge that is fixed to and spans said guides in a generally vertical plane when said guides are vertically disposed in said opening;

a floating gate having a lower edge that is disposed between said guides, and is positionable in an upper position where its lower edge is adjacent said upper edge so that it pivots within a plane that is generally orthogonal to said vertical plane, and in a lower position adjacent said lower gate to provide access to said filter cavity; and an upper latch mechanism for holding said floating gate between said guides in said upper position so that it pivots in said orthogonal plane, said upper latch mechanism comprising:

a pair of detents that are positioned in the respective tracks to form a pair of sockets at the tracks' upper ends; and a pair of slidable pins that are attached to the floating gate near its lower edge and positioned in said tracks, when said floating gate is in its upper position said pins are held in said sockets by said detents and when said floating guide is in its lower position said pins are positioned towards the tracks' lower ends.

5. The weir gate of claim 4, wherein said floating gate reciprocates between its upper and lower positions in a second generally vertical plane between said guides that is offset from said first vertical plane.

6. The weir gate of claim 5, wherein said upper latch mechanism comprises a pair of springs that allow the pins to deflect inward and pass the detents when the floating gate is moved between its upper and lower positions.

7. The weir gate of claim 4, further comprising a lower latch mechanism for holding said gate in said lower position in a second generally vertical plane.

8. The weir gate of claim 7, wherein said lower latch mechanism comprises an upper lip of said lower gate that overhangs an upper edge of said floating gate when the floating gate is in said lower position, thereby resisting upward movement of said floating gate.

9. A spa unit, comprising:

a molded shell that is formed with an interior for holding water and a recessed filter cavity, and has an opening between its interior and said recessed filter cavity;

a filter that is positioned in said recessed filter cavity for filtering the spa water; and a weir gate comprising:

a pair of spaced juxtaposed guides that are vertically disposed in said opening, a lower gate that is fixed to and spans said guides in a first generally vertical plane, said lower gate having a lower edge that is positioned against the molded shell and an upper edge that spans said guides at a fixed height above the molded shell, a floating gate that is disposed between said guides, said floating gate having lower and upper edges and a buoyancy that is capable of supporting its upper edge near the surface of the spa water, and a latch mechanism that holds said floating gate in an upper position with its lower edge pivotally affixed between the juxtaposed guides adjacent the lower gate's upper edge so that the floating gate pivots with respect to the first vertical plane with its upper edge floating near the surface of the water to draw the surface water over the floating gate into the filter cavity and through the filter, said latch mechanism being releasable so that said floating gate can be moved to a lower position, said latch mechanism reengaging the floating gate at said lower position and holding it adjacent said lower gate to provide access to said filter cavity through said opening.

10. The spa unit of claim 9, wherein said lower gate has an upper lip, said latch mechanism comprising:

a lower latch mechanism that is formed by said lower gate's upper lid overhanging the floating gate's upper edge when the floating gate is in said lower position to resist upward movement of said floating gate; and an upper latch mechanism for holding said floating gate between said guides in said upper position so that it pivots with respect to the first vertical plane.

11. The spa unit of claim 10, wherein the molded spa unit includes a fixed cover that is positioned over said recessed filter cavity.

12. The weir gate of claim 10, wherein at least one hole is formed in said lower gate.

13. The spa unit of claim 9, wherein the molded shell is formed with a permanent cover over the recessed filter cavity so that the only access to said filter is through said opening.

14. A spa unit, comprising:

a molded shell that is formed with an interior for holding water and a recessed filter cavity, and has an opening between its interior and said recessed filter cavity;

a filter that is positioned in said recessed filter cavity for filtering the spa water; and a weir gate comprising a pair of spaced juxtaposed guides with recessed tracks having upper and lower ends that are vertically disposed in said opening, a lower gate having an upper edge that is fixed to and spans said guides in a first generally vertical plane, and a floating gate having lower and upper edges and a buoyancy that is capable of supporting its upper edge near the surface of the spa water, said floating gate being attachable between said guides in an upper position where its lower edge is adjacent the lower gate's upper edge so that it pivots with respect to the first vertical plane and its upper edge floats near the surface of the water so that the surface water is drawn over the floating gate into the filter cavity and through the filter, and in a lower position that holds the floating gate adjacent said lower gate to provide access to said filter cavity; and an upper latch mechanism for holding said floating gate between said guides in said upper position so that it pivots with respect to the first vertical plane, said upper latch mechanism comprising:

a pair of detents that are positioned in the respective tracks to form a pair of sockets at the tracks' upper ends; and a pair of slidable pins that are attached to the floating gate near its lower edge and positioned in said tracks, when said floating gate is in its upper position said pins are held in said sockets by said detents and when said floating guide is in its lower position said pins are positioned towards the tracks' lower ends.

15. The weir gate of claim 14, wherein said floating gate reciprocates between its upper and lower positions in a second generally vertical plane between said guides that is offset from said first vertical plane.

16. The weir gate of claim 14, wherein said upper latch mechanism comprises a pair of springs that allow the pins to deflect inward and pass the detents when the floating gate is moved between its upper and lower positions.

17. The weir gate of claim 14, further comprising a lower latch mechanism for holding said gate in said lower position in a second generally vertical plane.

18. The weir gate of claim 17, wherein said lower latch mechanism comprises an upper lip of said lower gate that overhangs an upper edge of said floating gate when the floating gate is in said lower position thereby resisting upward movement of said floating gate.

* * * * *